US005948606A

United States Patent [19]

Begel et al.

[11] Patent Number: 5,948,606

[45] Date of Patent: Sep. 7, 1999

[54] PROTECTIVE TOP LAYER AND PHOTOGRAPHIC PRODUCTS CONTAINING THIS TOP LAYER

[75] Inventors: Yannick Begel, Chalon-Sur-Saone; Francois Jean-Marie Bredoux, Juvignac; Gerard Maurice Droin, Beaune, all of France

[73] Assignee: Eastman Kodak Company, Rochester, N.Y.

[21] Appl. No.: 08/638,396

[22] Filed: Apr. 25, 1996

Related U.S. Application Data

[63] Continuation-in-part of application No. 08/405,162, Mar. 16, 1995, abandoned.

[30] Foreign Application Priority Data

Mar. 31, 1994 [FR] France ..... 94 04266

[51] Int. Cl.[6] ..... G03C 1/76

[52] U.S. Cl. ..... 430/523; 430/631; 430/531; 430/637

[58] Field of Search ..... 430/631, 529, 430/531, 634, 635, 636, 961, 523, 567, 637

[56] References Cited

U.S. PATENT DOCUMENTS

| | | | |
|---|---|---|---|
| 2,536,764 | 1/1951 | Moulton . | |
| 5,037,871 | 8/1991 | Jones | 524/261 |
| 5,073,853 | 12/1991 | Steklenski et al. | 430/523 |

FOREIGN PATENT DOCUMENTS

| | | |
|---|---|---|
| 245 090 | 11/1987 | European Pat. Off. . |
| 2 688 604 | 9/1993 | France . |
| 1 466 600 | 3/1977 | United Kingdom . |
| 91/18325 | 11/1991 | WIPO . |

*Primary Examiner*—Thorl Chea
*Attorney, Agent, or Firm*—Carl F. Ruoff

[57] ABSTRACT

The present invention concerns a photographic material comprising, in addition to the conventional light-sensitive silver halide layers, a protective top layer.

According to the invention, the protective layer comprises, in combination, a surface-active fluorinated polyether and a vinyl polymer.

This protective top layer enables the appearance of marks during photographic processing to be prevented without modifying the sensitometric results.

9 Claims, No Drawings

PROTECTIVE TOP LAYER AND PHOTOGRAPHIC PRODUCTS CONTAINING THIS TOP LAYER

This application is a continuation-in-part of our prior, copending, U.S. patent application Ser. No. 08/405,162, filed Mar. 16, 1995.

The present invention concerns a photographic material comprising, in addition to the conventional light-sensitive silver halide layers, a protective top layer. More particularly, the invention concerns a reversal, color photographic paper comprising a protective top layer which prevents marks from appearing during photographic processing.

The use of photographic materials comprising a protective top layer is known. Such top layers are useful, for example, for protecting the photographic materials from fingermarks, abrasion or scratches which appear either during the preparation of the photographic materials or during photographic processing. These protective top layers may also provide a special surface texture such as matt surfaces, or they may be used as an anti-reflective layer.

These top layers may be temporary or permanent layers.

Such layers are obtained by applying to a photographic material a coating of solutions or dispersions with particular compositions. For example, U.S. Pat. No. 2,536,764 describes a top layer containing transparent solid particles with sizes smaller than one micrometre.

The patent application WO 91/18325 describes a photographic material comprising a protective layer consisting of (a) a hydroxylated latex, (b) a hydrolysed metal alkoxide and (c) a polyfluoroalkyether surfactant. The combination of these three compounds enables the photographic materials to be protected against abrasion.

European patent application 245 090 concerns a photographic material comprising a top layer consisting of a fluorinated compound and/or an anionic surfactant and a hardener with a high molecular weight. Such a top layer has antistatic properties.

The use, in protective layers, of surfactants in combination with a large number of compounds of very different kinds such as polymers, matting agents, hardeners, etc is therefore known.

It is, however, very difficult when working with photographic materials in general, and reversal color photographic materials in particular, to obtain a protective overcoat layer which performs the desired function while not impairing other physical or sensitometric properties of the material. Useful protective top layers should not only provide a protective effect, but they should be transparent and flexible, they should delay the kinetics of development no more than the overcoat layers which they replace, and they should not dissolve in the processing baths so as to impairs the physical or sensitometric properties of the material being processed.

We have found that the addition of a polymer into the overcoat of a photographic material can protect against processing marks. The shortcoming of this polymer addition is that the efficient amount of polymer is generally too high and impair other photographic parameters. It has been noticed that when the polymer is present in the overcoat in an amount efficient to reduce scuffmarks, it tends to be dissolved into the processing bath, producing dirt accumulation in it. The dissolved polymer tends to settle onto the film surface providing further surface defects.

The addition of surfactants to overcoats to improve the physical properties of the coated layer has a disadvantage in that it also tends to dirty the processing baths. Further, the surfactants tend to substantially modify the coating ability of the overcoat layer.

Thus, while it is known in general to add polymers and/or surfactants to overcoat layers of photographic materials, for example from Jones et al. U.S. Pat. No. 5,037,871 and U.K. Patent Specification 1,466,600, when such compounds are used in combination they either do not fully protect the element from scuff marks, or they modify the sensitometric properties of the material, or they create other physical defects in the material, or some combination of these.

A object of the present invention is to provide a photographic material comprising an overcoat layer which enables the problems of marks during photographic processing to be totally eliminated, but without substantially altering other photographic parameters.

In particular, the invention concerns a photographic material comprising a support covered with at least one light sensitive silver halide emulsion layer and a protective layer covering the light sensitive emulsion layer, the protective layer comprising a hydrophilic colloidal binder containing, in combination, at least one surface-active fluorinated polyether and at least one vinyl polymer obtained from at least one hydrophobic ethylenically unsatured monomer and one vinyl monomer substituted with at least one solubilizing group.

The photographic material of the present invention, when processed has a reduced tendency during processing to form scuffmarks. The polymer and the surfactant when combined in the overcoat substantially solve the scuffmark problem, and unexpectedly does not alter the other photographic parameters.

The hydrophobic ethylenically unsatured monomer is selected from the group consisting of alkyl or aryl acrylates and alkyl or aryl methacrylates wherein the alkyl group, substituted or unsubstituted, refers to groups having from 1 to 12 carbon atoms such as methyl, ethyl, propyl, butyl, octyl, ethylhexyl, cyclohexyl, etc., and the aryl group, substituted or unsubstituted, refers to groups having at least 6 carbon atoms.

Useful hydrophobic ethylenically unsatured monomers include methyl acrylate, ethyl acrylate, propyl acrylate, butyl acrylates, amyl acrylate, 2-ethylhexyl acrylates, octyl acrylate, 2-methoxyethyl acrylates, 2-butoxyethyl acrylates, 2-phenoxyethyl acrylates, cyanoethylacrylates, benzyl acrylates, methoxybenzyl acrylates, furfuryl acrylates, tetrahydrofurfuryl acrylates, phenyl acrylates, 2-acetoacetoxyethyl acrylates, methyl methacrylate, ethyl methacrylate, propyl methacrylate, isopropyl methacrylate, butyl methacrylates, amyl methacrylates, hexyl methacrylates, cyclohexyl methacrylates, benzyl methacrylates, octyl methacrylates, 2-methoxyethyl methacrylates, 2-acetoacetoxyethyl methacrylates, 2-(3-phenylpropyloxy) ethyl methacrylates, furfuryl methacrylates, tetrahydrofurfuryl methacrylates, phenyl methacrylates, naphthyl methacrylates.

The solubilizing group substituted vinyl monomer is selected from the group consisting of alkyl acrylates and alkyl methacrylates, N-alkyl acrylamide and N-alkyl methacrylamide, vinyl monomers being substituted with a solubilizing group selected from sulfo group, carboxyl group, phosphono group, sulfato group and sulfino group. The preferred solubilizing group substituted vinyl monomers are sulfo group substituted N-alkyl acrylamides and sulfo group substituted N-alkyl methacrylamides.

The vinyl polymer of the present invention can comprise of one or more above listed monomers. According to the invention, the vinyl polymer comprises at least two hydrophobic ethylenically unsatured monomers, preferably acrylate monomers.

According to one embodiment, the vinyl polymer is a terpolymer consisting of monomers (A), (B) and (C) having the following formula:

(A) $(R^3)_2C{=}CR^3{-}COOR^1$ (B) $(R^3)_2C{=}CR^3{-}COOR^2OCOR^2COR^1$ (C) $(R^3)_2C{=}CR^3{-}CONR^3R^2SO_3^{\ominus}X$ in which $R^1$ groups, which may be identical or different, are alkyl radicals with a straight or branched chain of 1 to 12 carbon atoms; $R^2$ groups, which may identical or different, are alkylene groups with a straight or branched chain of 1 to 10 carbon atoms; $R^3$ groups, which may be identical or different, are hydrogen or alkyl groups with a straight or branched chain having from 1 to 5 carbon atoms, and X is the cation associated with the sulfo group selected from alkali metal ions, ammonium or alkyl ammonium groups.

$R^3$ is preferably hydrogen or an alkyl group having from 1 to 4 carbon atoms. $R^2$ and $R^1$ preferably comprise from 1 to 4 carbon atoms.

For example, monomer (A) can be selected from $CH_2{=}CH{-}COOCH_3$, $CH_2{=}CCH_3{-}COOCH_3$, $CH_3CH{=}CCH_3{-}COOCH_3$, $CH_2{=}CH{-}COOC_2H_5$, $CH_2{=}CH{-}COOC(CH_3)_3$, $CH_2{=}CH{-}COOC_3H_7$, etc.; monomer (B) can be selected from $CH_2{=}CH{-}COOCH_2OCOCH_2COCH_3$, $CH_2{=}CCH_3{-}COOCH_2OCOCH_2COCH_3$, $CH_2{=}CH{-}COOCH_2CH_2OCOCH_2COC_2H_5$, $CH_2{=}CCH_3{-}COOCH_2CH_2OCOCH_2COC_2H_5$, $CH_3CH{=}CH{-}COOCH_2CH_2OCOCH_2COCH_3$, $CH_3CH{=}CH{-}COOCH_2CH_2OCOCH_2COC_2H_5$, $CH_2{=}CH{-}COOCH_2CH_2OCOCH_2COCH_3CH_2{=}CCH_3{-}COOCH_2CH_2OCOCH_2COCH_3$; monomer (C) can be selected from $CH_2{=}CH{-}CONHCH_2SO_3^-,Na^+$, $CH_2{=}CH{-}CONHCH_2CH_2SO_3^+,Na^+$, $CH_2{=}CH{-}CONHC(CH_3)_2CH_2SO_3^-,Na^+$, $H_3CCH{=}CH{-}CONHC(CH_3)_2CH_2SO_3^-,Na^+$ $CH_2{=}CCH_3{-}CONHC(CH_3)_2CH_2SO_3^+,Na^-$, etc.

According to another embodiment, the vinyl polymer is a vinyl terpolymer consisting of:

$$\left\{ \left[ {-}C(R^3)_2\underset{\underset{COOCH_2CH_2CH_2CH_3}{|}}{CR^3}{-} \right]_x \left[ {-}C(R^3)_2\overset{\overset{COOCH_2CH_2OCOCH_2COCH_3}{|}}{CR^3}{-} \right]_y \left[ {-}C(R^3)_2\underset{\underset{CONHC(CH_3)_2CH_2SO_3^{\ominus}X}{|}}{CR^3}{-} \right]_z \right\}$$

in which $R^3$ and X are such as defined above, x represents between 10% and 95% and preferably between 85% and 95% by weight of terpolymer, y represents between 3% and 50% and preferably between 5% and 10% by weight of terpolymer and z represents between 2% and 80% and preferably between 4% and 10% by weight of terpolymer, provided that the sum of x, y and z is 100%.

The preferred terpolymer according to the invention is the terpolymer in which x represents 88%, y represents 7% and z represents 5%.

Within the scope of the invention, the surface-active fluorinated polyethers are surfactants which contain an aliphatic moiety having from 3 to 16 carbon atoms at least partially substituted by fluorine atoms, and optionally aliphatic moieties having from 3 to 16 carbon atoms not substituted by fluorine. The polyether moiety preferably comprises at least 3 ether functions, more preferably from 9 to 14 ether functions. The polyether moiety may contain alkylene chains such as polyethylene or polypropylene chains.

According to one embodiment, the surface-active fluorinated polyethers are compounds or a mixture of compounds of the formula:

$$F(CF_2CF_2)_{3_8}CH_2\underset{\underset{R}{|}}{\overset{\overset{R}{|}}{C}}HO(CH_2CHO)_{9_13}H$$

in which R is a hydrogen atom or an alkyl group, for example methyl. A surfactant corresponding to this definition is Zonyl-FSN® manufactured by DuPont.

The quantity of surfactant which is used in the protective layer of the present invention is between 0.2 and 5.0 $mg/dm^2$, preferably 0.8 to 2.0 $mg/dm^2$.

The quantity of vinyl terpolymer which is used in the protective layer of the present invention is between 0.5 and 10 $mg/dm^2$, preferably between 1 and 5 $mg/dm^2$.

Preferred photographic materials with which the overcoat layers of this invention can be employed are the color reversal photographic papers described in PCT published Patent Application WO 93/19397, the disclosure of which is incorporated herein by reference.

According to one embodiment, a fine grain silver halide emulsion which does not participate in the formation of the image is introduced into the protective layer. Such an emulsion has been described in detail in the patent application WO 93/19397. This emulsion is preferably a silver bromochloride fine-grain emulsion containing 50% molar silver bromide.

The protective layer can contain other compounds useful in photography. The protective layer of the invention may be used on any type of colour or black and white photographic material, such as negative, positive or reversible materials.

The colour photographic materials generally comprise a support carrying at least one blue-sensitive silver halide emulsion layer with which is associated a yellow dye forming coupler, at least one green-sensitive silver halide emulsion layer with which is associated a magenta dye forming coupler, and at least one red-sensitive silver halide emulsion layer with which is associated a cyan dye forming coupler.

These materials may contain other layers which are conventional in photographic materials, such as spacing layers, filter layers and anti-halo layers. The support may be any appropriate support used for photographic materials. Conventional supports include polymer films, paper (including paper coated with polymer), glass and metal. *Research Disclosure*, December 1978, No. 17643, Section XVII, provides details concerning supports and auxiliary layers for photographic materials.

The preparation of light-sensitive silver halide emulsions is described, for example, in *Research Disclosure*, No. 17643, Sections I and II. Silver halide emulsions may be chemically sensitised according to the methods described in Section III of the *Research Disclosure* referred to above. The chemical sensitisers generally used are sulphur and/or selenium and gold compounds. Sensitisation by reduction can also be used. The halide grains may have different compositions. It is possible for example to use silver bromide, silver iodobromide, silver chloride, silver chloroiodide or silver chlorobromoiodide grains. The silver halide grains may be spherical, cubic, octahedral, cubo-octahedral or tabular. The silver halide grains may be core/shell grains, for example as in U.S. Pat. No. 3,505,068, or may have epitaxial deposits as in U.S. Pat. No. 4,713,320. These silver halide emulsions may also contain doping agents, such as rhodium, indium, osmium, iridium, etc ions, generally in small quantities.

The silver halide emulsions and other layers for photographic materials of this invention may contain, as a carrier, hydrophilic colloids, used alone or in combination with other polymer substances (for example latexes). The appropriate hydrophilic substances comprise both natural substances such as cellulose derivatives—for example cellulose esters, proteins or protein derivatives, gelatin, gelatin treated with a base (bone gelatin or tanned gelatin) or gelatin treated with an acid (pigskin gelatin), gelatin derivatives, for example acetylated gelatin, phthalated gelatin etc, or polysaccharides such as dextran, gum arabic, zein, casein, pectin, collagen derivatives, collodion, agar-agar and albumin.

The emulsions may be polydisperse or monodisperse, or may consist of a mixture of emulsions having different grain sizes and/or compositions.

The spectral sensitisation, or chromatisation, methods are described in the same publication, Section IV. The sensitising dyes may be added at various stages in the preparation of the emulsion, particularly before, during or after chemical sensitisation.

The silver halide emulsions may be spectrally sensitised with dyes from various classes, including the class of polymethine dyes, which comprises cyanines, merocyanines, complex cyanines and merocyanines (ie tri-, tetra- and polynuclear cyanines and merocyanines), oxonols, hemioxonols, styryls, merostyryls and streptocyanines. The *Research Disclosure* No. 17643 cited above, Section IV, describes representative spectral sensitising dyes.

The photographic materials of the invention may contain, inter alia, optical brighteners, anti-fogging compounds, surfactants, plasticisers, lubricants, hardeners, stabilisers, and absorption and/or diffusion agents as described in Sections V, VI, VIII, XI, XII and XVI of the *Research Disclosure* cited above.

The methods for adding these different compounds and the methods for coating and drying are described in Sections XIV and XV.

The photographic materials, after being exposed, undergo a photographic process comprising a silver development of the latent image (black and white development), and a chromogenic development in the presence of a chromogenic developer and a coupler, which in certain cases may be incorporated into the photographic material.

The photographic materials are then washed and subjected to a bleaching and then a fixing bath, before being processed in a stabilising bath. The bleaching and fixing baths may be replaced by a single bleach/fixing bath.

The silver development is carried out in the presence of a reducing compound which enables the exposed silver halide grains to be transformed into metal silver grains. These compounds are chosen from the dihydroxybenzenes such as hydroquinone, the 3-pyrazolidones, the aminophenols, etc. These compounds may be used alone or in a mixture. This first bath may, in addition, contain a stabiliser such as sulphites, a buffer such as carbonates, boric acid, borates or alkanolamines.

The chromogenic developer contained in the chromogenic development bath which enables the colour image to be obtained is generally an aromatic primary amine such as the p-phenylenediamines, and more particularly the N,N-dialkyl-p-phenylenediamines, where the alkyl radicals and the aromatic nucleus may be substituted or not. The p-phenylenediamines used as chromogenic developers are for example N,N-diethyl-p-phenylenediamine monochlorhydrate, 4-N,N-dimethyl-2-methylphenylenediamine monochlorhydrate, or 4-(N-ethyl-N-2-hydroxyethyl)-2-methylphenylenediamine sulphate. This chromogenic developing bath may contain other compounds such as stabilisers, development accelerators, which are generally pyridinium compounds, or other compounds.

The essential compound of the bleaching bath is an oxidising compound which transforms the metal silver into silver ions such as, for example, the alkaline metal salts of a ferric complex of an aminocarboxylic acid, or persulphate compounds.

The bleaching compounds commonly used are ferric complexes of nitrolotriacetic acid, ethylenediamine tetracetic acid, 1,3-propylenediamine tetracetic acid, triethylenetriamine pentacetic acid, ortho-diaminocyclohexane tetracetic acid, ethyliminodiacetic acid, etc.

The fixing bath enables the silver halide to be completely transformed into a soluble silver complex which is then eliminated from the layers of the photographic material. The compounds used for fixing are, for example, thiosulphates such as ammonium thiosulphates or alkaline metal thiosulphates. Stabilisers or sequestering agents may be added to the fixing bath.

The processing generally comprises a stabilising bath containing a colour stabiliser such as formaldehyde, and a wetting agent.

According to one embodiment, the photographic materials of the invention are reversal materials as described in the patent application WO 93/19397.

After being exposed, the reversal materials undergo photographic processing comprising, after the silver development step, a reversal step which consists of making the unexposed residual silver halide grains developable by means of a fogging exposure or a chemical fogging and subjecting these fogged silver halide grains to a chromogenic development in the presence of a chromogenic developer and a coupler, the latter generally being incorporated in the material.

In the following examples, the photographic material is a colour reversal material which is exposed and then processed according to the standard method of Ektachrome® R-3 process.

EXAMPLE 1 (CONTROL)

The photographic material used in the following example is the Ektachrome® photographic material of the Radiance® type to which has been applied a protective layer comprising gelatin and a fine grain silver bromochloride emulsion (50% bromide) which does not participate in the formation of the image with an average equivalent spherical diameter of 0.11 $\mu$m, and in a proportion of 0.15 mg/dm$^2$. The photographic material has been hardened by means of a quantity of hardener of around 0.9% by weight of total gelatin introduced into one of the light-sensitive photographic layers.

The material thus obtained is exposed to the light of a tungsten lamp (2850° K.). It is then processed in a processing machine comprising conventional Ektachrome® R-3 process.

The standard Ektachrome® R-3 process comprises the following stages:

| | |
|---|---|
| Black and white development | 1 min 15 sec |
| Washing | 1 min 30 sec |
| Re-exposure | |
| Chromogenic development (38° C.) | 2 min 15 sec |
| Washing | 0 min 45 sec |
| Bleaching/fixing | 2 min |
| Washing | 2 min 15 sec |

EXAMPLE 2 (Comp.)

A protective layer, as defined in Example 1 and containing in addition the vinyl terpolymer (PI), is applied to the Radiance® photographic material. A protective layer with a vinyl terpolymer content of 1 mg/dm$^2$ is thus obtained.

The photographic material obtained is then processed according to the process described in Example 1.

(PI)

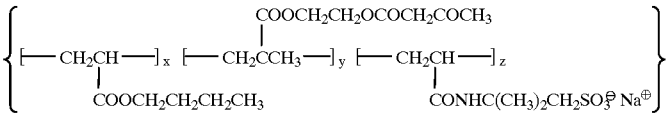

in which x represents 88% by weight of terpolymer, y represents 7% by weight of terpolymer and z represents 5% by weight of terpolymer.

EXAMPLE 3 (Comp.)

An aqueous coating composition of Example 2 is applied to the photographic material of Example 1, modifying the vinyl terpolymer (PI) quantity in order to obtain a protective layer with a terpolymer content of 2 mg/dm$^2$.

The photographic material obtained is then processed according to the process described in Example 1.

EXAMPLE 4

A protective layer as defined in Example 1 and containing in addition to the gelatin and fine grain emulsion which does not participate in the formation of the image, the Zonyl-FSN® and the terpolymer (PI), is applied to the Radiance® photographic material.

A protective layer is thus obtained with a Zonyl-FSN® surfactant content of 1 mg/dm$^2$ and a copolymer content of 1 mg/dm$^2$.

The photographic material obtained is then processed according to the process described in Example 1.

EXAMPLE 5

In this example, the protective layer of Example 4 is reproduced and the hardener content is increased from 0.9 to 1.3% by weight of total gelatin, this hardener being introduced into one of the light-sensitive photographic layers.

The photographic material obtained is then processed according to the process described in Example 1.

EXAMPLE 6 (comp)

A protective layer as defined in Example 1 and containing in addition to the gelatin and fine grain emulsion which does not participate in the formation of the image, the Zonyl-FSN®, is applied to the Radiance® photographic material (2 mg/dm$^2$).

The photographic material obtained is then processed according to the process described in Example 1.

The addition of Zonyl FSN does not substantially solve the scuff mark problem, but reduce the bleaching kinetic.

RESULTS

The results of Examples 1 to 6 are summurized in Table 1 below. The number of "M" represents the mark level which appears during photographic processing and the number of "S" represents the magnitude of the impurities which appear on the surface of the processing baths after developing each photographic material described above.

| | Marks | Impurities |
|---|---|---|
| Ex. 1 (Control) | MMMM | — |
| Ex. 2 (comp.) | MMM | — |
| Ex. 3 (Comp.) | MM | ss |
| Ex. 4 (inv) | — | — |
| Ex. 5 (inv) | — | — |
| Ex. 6 (Comp) | M | — |

In the above table, it can be seen that the combination, in the protective layer, of a fluoroalkylated polyether with a vinyl polymer of the invention enables the appearance of marks during photographic processing to be eliminated without contaminating the processing baths.

The comparative Examples 2 and 3 show that the presence of the vinyl polymer of the invention, in the protective layer reduces the appearance of marks during processing. However, such a reduction is obtained from a polymer level which causes the baths to become contaminated very rapidly by dissolution of the polymer into the processing bath. This affects the brightness of the surface paper and produces surface defects. Such a solution is not fully satisfactory to solve the scuffmark problem.

Examples 4 and 5 show that the use of the vinyl polymer in combination with the fluorinated polyether in the protective layer enables the marks due to processing to be completely eliminated. Moreover, the development kinetics remains comparable to that obtained with the photographic material of Example 1 and no impairment of the sensitometric properties is observed. In particular the speed of the photographic material is not impaired.

It has been further noticed that the combination of Zonyl FSN and PI has an improved efficiency against scuffmarks. The efficient polymer level into the overcoat is thus reduced, that prevent the contamination of processing baths.

Examples 4 and 5 in the above table show that the tanning level has no influence on the appearance of marks during processing, in the presence of the protective layer of the invention.

Example 6 show that the Zonyl FSN, when used alone does not provide a satisfactory solution to the scuffmark problem.

From examples 3 and 6, it is quite surprising to substantially solve the problem of the scuffmarks with a combination of two compounds, that are, when used alone, not fully satisfactory.

EXAMPLE 7

A protective layer as defined in Example 1 and containing in addition to the gelatin and fine grain emulsion which does not participate in the formation of the image, the surfactants below mentioned in Table 2, is applied to the Radiance® photographic material.

A protective layer is thus obtained with a surfactant content as specified above.

The photographic material obtained is then processed according to the process described in Example 1.

TABLE 2

| | Surfactant ($mg/dm^2$) | Marks | Impurities |
|---|---|---|---|
| EX. 7 (1) | SA - I (2 $mg/dm^2$) | MMMM | |
| EX. 7 (2) | SA - II (2 $mg/dm^2$) | MMMM | |
| EX. 7 (3) | SA - III (1 $mg/dm^2$) | M | SS |
| EX. 7 (4) | SA - IV (0, 6 $mg/dm^2$) | MMMM | |

SA - I: polydimethylsiloxane
SA - II: polysiloxane polyorganobetaine copolymer
SA - III: dimethyl siloxane oxyethylene copolymer
SA - IV: alkanol XC (Q427)

These examples show that the addition of the above mentioned surfactants in the overcoat layer has no influence on the scuffmark apparition.

EXAMPLE 8

A protective layer as defined in Example 1 and containing in addition to the gelatin and fine grain emulsion which does not participate in the formation of the image, the surfactants below mentioned in Table 3 and PI, is applied to the Radiance® photographic material.

A protective layer is thus obtained with a surfactant and polymer content as specified above.

The photographic material obtained is then processed according to the process described in Example 1.

TABLE 3

| | Polymer ($mg/dm^2$) | Surfactant ($mg/dm^2$) | Marks | Impurities |
|---|---|---|---|---|
| EX. 8 (1) | PI (2 $mg/dm^2$) | SA - I (2 $mg/dm^2$) | MM | |
| Ex. 8 (2) | PI (2 $mg/dm^2$) | SA - II (2 $mg/dm^2$) | MM | |

TABLE 3-continued

| | Polymer ($mg/dm^2$) | Surfactant ($mg/dm^2$) | Marks | Impurities |
|---|---|---|---|---|
| EX. 8 (3) | PI (2 $mg/dm^2$) | SA - III (1 $mg/dm^2$) | M | SS |
| EX. 8 (4) | PI (2 $mg/dm^2$) | SA - IV (0, 6 $mg/dm^2$) | M | |

SA - I : polydimethylsiloxane
SA - II: polysiloxane polyorganobetaine copolymer
SA - III: dimethyl siloxane oxyethylene copolymer
SA - IV: alkanol XC (Q427)

The combination of PI with the above exemplified surfactants solves only partially the scuffmark problem.

The invention has been described by reference to preferred embodiments, but it will be understood that changes can be made to the materials and elements specifically described herein within the spirit and scope of the invention.

What is claimed is:

1. Photographic material comprising a support, at least one light-sensitive silver halide emulsion layer and a protective layer covering the light-sensitive emulsion layer, the protective layer comprising a hydrophilic colloidal binder, containing at least one surface-active fluoroalkylated polyether and at least one vinyl polymer obtained from at least one hydrophobic ethylenically unsaturated monomer and one vinyl monomer substituted with at least one solubilizing group.

2. Photographic material according to claim 1 wherein the vinyl polymer is obtained from the monomers (A), (B) and (C) of formula:

(A) $(R^3)_2C{=}CR^3{-}COOR^1$ (B) $(R^3)_2C{=}CR^3{-}COOR^2OCOR^2COR^1$ (C) $(R^3)_2C{=}CR^3{-}CONR^3R^2SO_3^{\ominus}X$ in which $R^1$ groups, which may be identical or different, are alkyl radicals with a straight or branched chain of 1 to 12 carbon atoms; $R^2$ groups, which may identical or different, are alkylene groups with a straight or branched chain of 1 to 10 carbon atoms; $R^3$ group is hydrogen or an alkyl group with a straight or branched chain having from 1 to 5 carbon atoms, and X is the cation associated with the sulfo group selected from alkali metal ions, ammonium or alkyl ammonium groups.

3. Photographic material according to claim 1, in which the surface-active fluoroalkylated polyether is defined by the formula:

$$F(CF_2CF_2)_{3_8}CH_2\overset{\overset{\displaystyle R}{|}}{C}HO(CH_2\underset{\underset{\displaystyle R}{|}}{C}HO)_{9_13}H$$

in which R is hydrogen or a methyl group.

4. Photographic material according to claim 1, in which the vinyl polymer is a vinyl terpolymer consisting of:

$$\left\{ [-C(R^3)_2\underset{\underset{\displaystyle COOCH_2CH_2CH_2CH_3}{|}}{C}R^3-]_x\ [-C(R^3)_2\overset{\overset{\displaystyle COOCH_2CH_2OCOCH_2COCH_3}{|}}{C}R^3-]_y\ [-C(R^3)_2\underset{\underset{\displaystyle CONHC(CH_3)_2CH_2SO_3^{\ominus}X}{|}}{C}R^3-]_z \right\}$$

in which $R^3$ groups, identical or different, are hydrogen atom, an alkyl radicals with a straight or branched chain of 1 to 5 carbon atoms, X is the cation associated with the sulfo group selected from alkali metal ions, ammonium or alkyl ammonium groups, and x represents between 10% and 95% and preferably between 85% and 95% by weight of terpolymer, y represents between 3% and 50% and preferably between 5% and 10% by weight of terpolymer and z represents between 2% and 80% and preferably between 4% and 10% by weight of terpolymer, provided that the sum of x, y and z is 100%.

5. Photographic material according to claim 4, in which the vinyl terpolymer is such that x is 88%, y is 7% and z is 5%.

6. Photographic material according to claim 5, in which the terpolymer content in the protective layer is between 0.5 and 10 $mg/dm^2$.

7. Photographic material according to claim 1, in which the surface-active fluoroalkylated polyether content in the protective layer is between 0.2 and 5 $mg/dm^2$.

8. Photographic material according to claim 1, in which the protective layer further comprises a fine grain silver bromochloride emulsion layer which does not participate in the formation of the image, the silver bromochloride grains having a bromide content of about 50 mole % and an average size below 0.5 $\mu$m.

9. A reversal color photographic paper comprising a paper support, a light-sensitive reversal silver halide emulsion layer and a protective overcoat layer on the opposite side of the emulsion layer from the support, the protective overcoat layer comprising a gelatin binder, a fluoroalkylated polyether surfactant, and a vinyl polymer obtained from a hydrophobic ethylenically unsaturated monomer and a vinyl monomer containing a solubilizing group.

* * * * *